US007472429B1

(12) United States Patent
Lawrence

(10) Patent No.: US 7,472,429 B1
(45) Date of Patent: Jan. 6, 2009

(54) STATIONARY GUARD AND BRACE FOR A BASEBALL CAP-TYPE VISOR

(76) Inventor: Lonnie L. Lawrence, 1024 N. County Rd. W., Odessa, TX (US) 79763

( * ) Notice: Subject to any disclaimer, the term of this patent is extended or adjusted under 35 U.S.C. 154(b) by 314 days.

(21) Appl. No.: 10/908,250

(22) Filed: May 4, 2005

Related U.S. Application Data

(60) Provisional application No. 60/568,207, filed on May 6, 2004.

(51) Int. Cl.
*A42B 1/24* (2006.01)

(52) U.S. Cl. ..... 2/209.13; 2/255; 223/14

(58) Field of Classification Search ..... 2/195.6, 2/209.13, 209.013, 195.1, 255, 175.2, 175.4, 2/195.4, 195.5; 223/84, 12, 14, 24, 52.2; 40/329

See application file for complete search history.

(56) References Cited

U.S. PATENT DOCUMENTS 1,452,862 A * 4/1923 Woodard ..... 105/80
2,699,553 A * 1/1955 Harold et al. ..... 40/329
5,003,639 A * 4/1991 White ..... 2/46
5,410,761 A * 5/1995 Connelly et al. ..... 2/195.1
5,634,575 A * 6/1997 Scharrenberg ..... 223/84
5,659,896 A * 8/1997 Taylor ..... 2/12
5,862,522 A * 1/1999 Cho ..... 2/195.1
5,956,773 A * 9/1999 LaMantia ..... 2/195.1
5,991,927 A * 11/1999 Barbaccia ..... 2/209.13
6,314,583 B1 * 11/2001 Cho ..... 2/195.1
6,755,329 B2 * 6/2004 Thompson ..... 223/14

* cited by examiner

*Primary Examiner*—Gary L Welch
*Assistant Examiner*—Richale L Quinn
(74) *Attorney, Agent, or Firm*—Law Office of Tim Cook P.C.

(57) ABSTRACT

A visor guard and brace adapted to shape and protect the visor of a baseball cap is provided. The brace is preferably comprises a rigid "U" shaped plate slid over the edge of the visor. The brace releasably attaches and constrains the surface of the visor and forces the visor to conform to one particular, user selectable shape. The brace remains attached to the visor as the cap is worn by the user to permanently guard against grime, dirt, tears, or fraying. The plate itself provides a long lasting improved esthetic appearance with or on the visor of the cap with or without additional ornamentation attached to the brace.

20 Claims, 1 Drawing Sheet

STATIONARY GUARD AND BRACE FOR A BASEBALL CAP-TYPE VISOR

This application claims the benefit of U.S. Provisional Application Ser. No. 60/568,207 filed May 6, 2004.

FIELD OF THE INVENTION

The present invention relates generally to the field of head coverings which have a flexible crown and a generally horizontally extending visor, such as a ball cap, and more particularly to a device providing a wearable protective cover for the visor of such a ball cap while maintaining the desired shape of the visor.

BACKGROUND OF THE INVENTION

Various ways to bend and shape visors of baseball caps have been used for some time. A visor's main distinguishing characteristic typically includes a fabric covered canopy made of cardboard or plastic generally affixed to a portion of the rim of the flexible crown of a baseball cap. The visor is adapted to extend over the eyes of the wearer to shade the wearer's eyes. Other similar visors are affixed to hat gear that have no crown for the head of a user, but rather are affixed to a rim that fits around the user's head and extend over the eyes, leaving the top of the user's head exposed. Preferably, the visor of a hat shades and protects portions of the wearer's face from the sun, wind, rain, and other elements.

The visor is usually made of a material to give it a certain amount of stiffness to retain a desired shape. Unfortunately, the fabric of the visor gets dirty or torn over time. By grasping the visor with the user's hands, the user often will manually bend the visor to a desired curvature according to the user's preference. By constantly manipulating the cap visor, the visor gets dirty and even torn over time from such normal use. Other visors are somewhat pre-curved from the manufacturer but still are constantly handled by the user. The curvature of the visor, over time, gets out of shape and the user has to start over, compounding the problem of the visor getting dirtier and more worn.

Thus, maintaining a particular desired curvature of the visor requires a constant effort. In any case, no presently known device addresses the need for permanently curving the baseball cap visor to only one very rigid shape, while keeping the baseball cap visor clean, hiding dirty and worn spots or tears, and decorating the visor.

Many devices for baseball cap type visor shaping exist in the art. For example, U.S. Pat. No. 5,533,652 and U.S. Pat. No. 5,908,146 both issued to Levin relate to a cap visor shaping, transport, storage, washing and/or display device including a lateral member with two hook tabs extending up to retain a cap visor with the lateral or central member being arched upwardly in the center with the hook tabs forming a shoulder to receive both sides of a cap visor. An elastic strap extends over the top of the visor to bend the visor to a desired curvature.

U.S. Pat. No. 6,234,367 issued to McCallister teaches a similar device for bending a cap visor. The device includes first and second interconnected block members each having an S-shaped portion upwardly extending from the outer edge thereof that forms a groove on the upper surface for receiving a side edge of a cap visor. A threaded shaft extends from one of the block members and alternately continues with a threaded bore on the other block member so that rotation of the screw in the shaft moves the blocks closer or farther apart. A user can bend a cap visor to a desired curvature by securing the visor within the block grooves and moving the blocks a select distance until the desired curvature is achieved.

U.S. Pat. No. 5,634,575 issued to Scharrenberg relates to another apparatus and method of reforming cap visors. The device includes a visor shaped upper member having a pair of adjustable retention plate strips that snap to each other for bending and retaining a cap visor. The pair of elongated retention plate devices are attached to the upper visor member that is laid on top of the visor. The visor member then bends the cap visor as the two retention plate strips are attached together at the desired juncture the user demands.

U.S. Pat. No. 4,927,063 issued to Fricano relates to a combination cap hanger and cap visor press that includes spring loaded gripping members with a curved form to receive a cap visor. The curvature of the gripping members and the force of the spring combine to press the cap visor into a desired shape. The device has a hanging member portion that is formed in the gripping member to allow the cap to be hung by the visor.

U.S. Pat. No. 5,074,508 issued to Powers provides a retention hook tab with a barb located within a vehicle to insert the cap visor and support the cap out of the way while not being worn.

U.S. Pat. No. 5,163,589 issued to Biehl relates to a cap press including a cylindrical base portion for stretching the body of the cap and a visor clamp with a pair of jaws operably connected to press the cap visor into a predetermined shape.

U.S. Pat. No. 5,161,719 issued to Otteson et al. relates to a cap shaping and drying device having a mesh support frame for the crown and a wire framed projection member for supporting and shaping the visor and is particularly useful for allowing the crown and cap to keep the shape the user intends after washing and drying time.

U.S. Pat. No. 6,196,428 issued to Robak is essentially another cap visor shaping device that consists of a rectangular arched body with a molded hollow sleeve on each end and a molded hanger type hook in the center portion of the body. On one end is a cylindrical sleeve for inserting the visor of a cap and on the other end is another cylindrical sleeve to insert the visor of another cap for shaping. The device has a hanger feature between the two cylinders to hang the hat on a clothes hanger rod.

Thus, many different devices exist in prior art for bending and shaping the baseball cap type visor, although none addresses the need for a replaceable brace to permanently maintain a user selectable shape of a baseball cap type visor while also adorning and protecting the visor of the ball cap from normal wear and tear during normal use. The present invention addresses these and other needs in the art.

SUMMARY OF THE INVENTION

The present invention provides a plate of rigid material defining a brace which may be slipped onto a cap visor by the user and then semi-permanently retain its shape in one position, provide protection against smudging, and hide frayed edges. If desired, the user may remove the brace and replace it with another such brace with a different adornment and shape.

It is therefore an object of this invention to provide a device when applied to a baseball cap type visor that is lightweight, inexpensive, and unobtrusive, suitable to be worn with the visor head gear.

It is a further object of this invention to provide a device when applied to a baseball cap type visor may be removed and placed on another cap visor.

It is yet another object of this invention to provide a device when applied to a baseball cap type visor will cover frayed or worn areas on the bill so as to look good to the user.

It is also an object of this invention to provide a device when applied to a baseball cap type visor provides protection from dirt and grime from handling and tossing around.

It is an object of this invention to provide a device when applied to a baseball cap type visor that can be reversed to make the cap bill edges turn upwards instead of the edges down.

It is yet another object of this invention to provide a device when applied to a baseball cap type visor which does not have to be attached every time the user stores the baseball cap type visor or detached every time the user decides to wear the visor head gear.

It is still further an object of this invention to provide a device when applied to a baseball cap type visor that when worn on the baseball cap type visor has a pleasing, aesthetic, ornamental, look to the eye.

It is a further object of this invention to provide a device when applied to a baseball cap type visor will afford the user a way to make the visor curve one permanent shape while being stored.

It is still another object of this invention to provide a device for a baseball cap type visor that may be used for advertising.

These and other object, features, and advantages will be immediately apparent to those of skill in the art from a review of the following detailed description along with the accompanying drawings.

BRIEF DESCRIPTION OF THE DRAWINGS

So that the manner in which the above recited features, advantages and objects of the present invention are attained and can be understood in detail, more particular description of the invention, briefly summarized above, may be3 had by reference to embodiments thereof which are illustrated in the appended drawings.

DETAILED DESCRIPTION OF PREFERRED EMBODIMENTS

Figure 3:
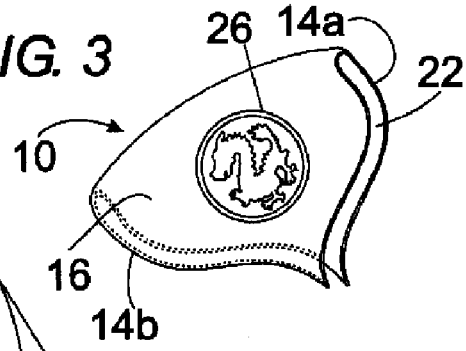
FIG. 3 is an isometric view of a preferred embodiment of the device with the replaceable device of FIG. 2 affixed to the device.
Figure 4:
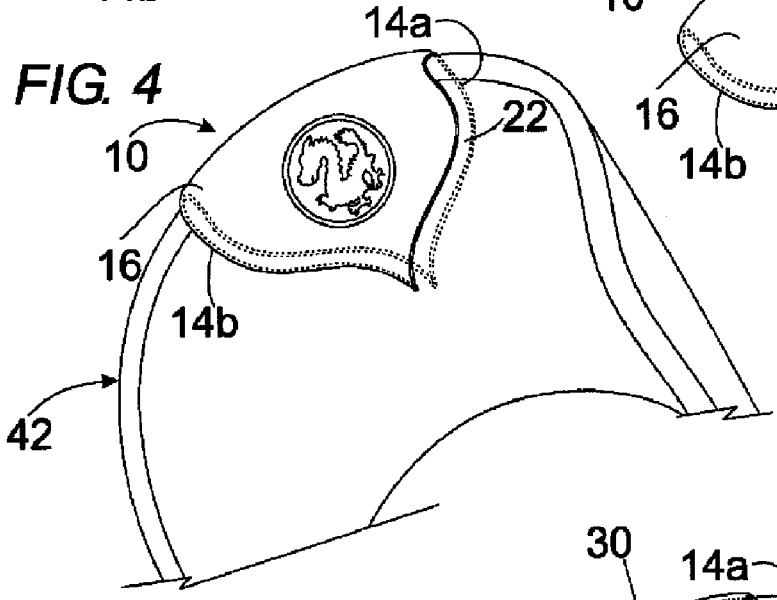
FIG. 4 is an isometric view of a preferred embodiment of a brace of rigid material of FIG. 3 with the cap type visor slid into the brace.
Figure 5:
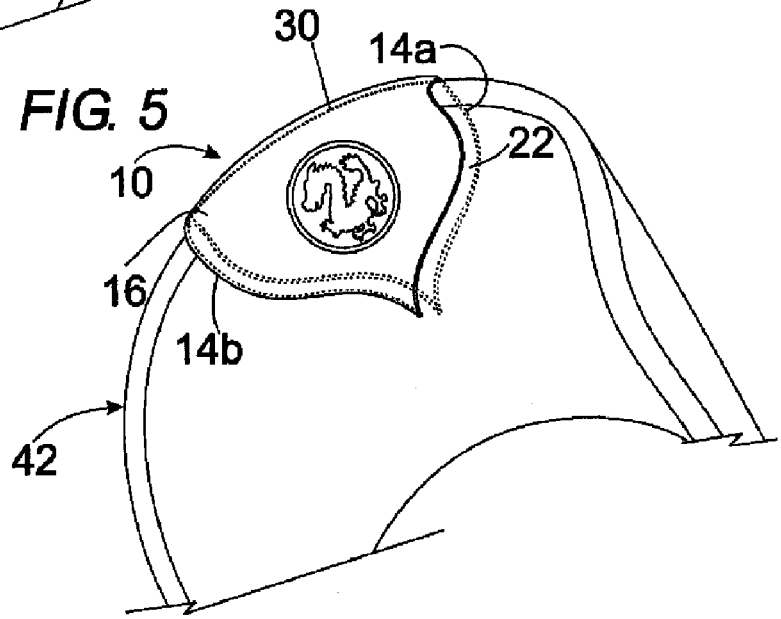
FIG. 5 is an isometric view of another preferred embodiment of the device shown here as a two plates soldered together to form a brace with the cap type visor slid into the brace.

FIGS. 1 through 5 depict a presently preferred embodiment of a visor guard and brace 10 of the present invention. The brace 10 comprises a plate 16 curved substantially into a "U" shape defining a top planar member 14*a* of the plate 16 and a bottom planar member 14*b* of the plate 16. The planar members 14*a* and 14*b* are spaced apart to provide a void 22 with sufficient gap to grip the visor of a ball cap, as shown in FIGS. 4 and 5.

Figure 1:
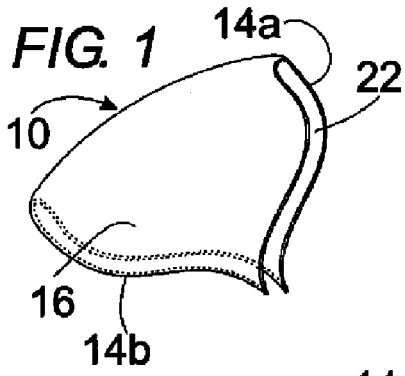
FIG. 1 is a perspective view of the present invention showing a baseball cap type brace of rigid material adapted to be placed onto a visor.
Figure 2:
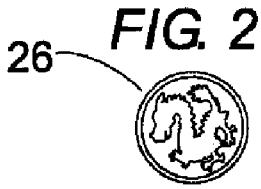
FIG. 2 is a plan view of a replaceable device to be affixed to the brace of FIG. 1.

The plate 16 of the brace 10 of the embodiment of FIGS. 1, 3, and 4 is preferably stamped or molded, but it may be extruded, die cast, cut out or other appropriate manufacturing techniques known or discovered in the art. Such units are preferably made out of a metal material, most preferably from thin, tempered aluminum or steel stock or other such treated and blended metal alloys that lend themselves to a very stiff property that renders itself to being absolutely rigid. Alternatively, the plate may be formed of a rigid material that may be manually formed by the user as desired, so long as it is sufficiently rigid to form the visor of the cap.

Many other materials lend themselves to such rigid properties allowing for practically no bend or motion, yet having casting, cutting or stamping ease and thus the preference of tempered aluminum or steel should not limit the scope of the invention. For example, the device may be made of a precious metal, spring steel, metal alloy, spring alloy, rigid polymer, polyolefins, polyamides, polyethylene, polypropylene, and copolymers and terpolymers thereof. While the manufacture of the visor guard and brace device 10 by a multi-step process of using a metal material of a particular stock, that is subsequently stamped, cast, molded, or cut is preferred, it can also be appreciated that the visor guard and brace device 10 can also be thermoformed or a combination thereof, such as is the case with a corrugated carbide fiber plastic or other similar plastic or nylon raw materials and such materials are well within the scope of the present invention.

Considering the many different variables of fastening the device to the visor, the gripping mechanism of the device by reason of a void 22 is only one preferred embodiment of many different types of fastening mechanisms capable of gripping the baseball cap type visor edge, including teeth running any length along the bottom or top edge of the top and bottom surfaces as well as glue could suffice to hold the device in place and should not limit the scope of how the device may attach.

As previously described, the plate 16 in FIG. 1 is preferably molded, cast, cut or stamped from stock in various lengths and widths and formed flat or arched in various degrees of shape. Once so formed, the plate 16 is preferably similar in size and appearance to any substantial amount of the front portion of the cap bill and has a cross-sectional width of approximately one-half inch to three inches in the center portion and a length of approximately 3 to 11 inches depending on the width of the visor intended, and a cross-sectional width of approximately one-half inches on each end and a thickness of approximately 1 millimeter.

The plate 16 receives the edges of a baseball cap type visor 42 that are inserted into the gap or void 22, as shown in FIG. 4. A preferred embodiment of the visor guard and brace 10 of FIG. 4 arches substantially under the baseball cap type visor 42, the plate 16 pushing the central portion of the baseball cap type visor 42 in an arch shape while grasping and pulling the edges of the baseball cap type visor 42 in the opposite direction after insertion. By grasping the baseball cap type visor edge 42 on the left or right side, with one hand, the user can first grasp the plate 16 with the other hand, making sure that the void 22 aligns with the edge of the visor 42, and then push the baseball cap type visor edge 42 into the void 22 filling the gap or void 22 in FIG. 4.

Additionally, the plate may also take on other esthetic characteristics, such as having a Florentine finish or having more curves and bends to produce different designs while maintaining the functions just described.

FIG. 5 depicts another preferred embodiment of an ornamental baseball cap type visor guard and brace device 10 formed of two plates, top and bottom, welded or brazed together along a seam or joint 30. The placement of the seam or joint could be more or less moved substantially lower or higher depending on manufacturability constraints. Alternatively, the top and bottom planar members may be releasably joined together. The embodiment of FIG. 5 conforms in all other respects to the structure and function previously described in respect of FIGS. 1-4.

In FIGS. 2-5, a display device 26 may be affixed to the brace 10. The display device is preferably made of a material that can be stamped, cut, engraved, painted or molded and can render any number of esthetic objects and can have a reflective surface as well, or a surface for advertisement or illustrate other recognizable object as desired by the user. The ornamental plate 26 is preferably small enough to be placed somewhere on the plate member 16.

Other ornamentation, without detracting from the utility of the invention, may allow for the visor guard and brace device to be used as ornamentation of the ballcap. Such additional features include the plate member having an ornamental affixed design on the plate surface, either painted, cut, molded or affixed to the plate. Additionally, the device 26 may substantially cover the entire device 10. Furthermore, the brace 10 may also render itself to different shapes other than an arch, for example the plate 16 may more closely define a flat shape, the brace 10 being more than able to hold a shape permanently according to a user selectively choosing a pre-styled shape. Finally, the brace 10 with or without the device 26 may be packaged for resale as a single unit or a separate units.

While the preferred embodiment of the invention comprises a substantially rigid plate, the plate may also be made of a relatively pliable material that is reinforced to hold a user desired shape. In this embodiment, the plate is moldable by a wearer and further it may be formed of a fluorescent material or other material to enhance the visibility of the guard and brace.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A visor guard and brace, adapted to attach to and remain on a visor of a cap while worn by a wearer, the visor having a top surface, a bottom surface, a left edge, a right edge, and a front edge, the guard and brace comprising:

a substantially rigid plate of predetermined area adapted to conform to a surface of a cap visor and to cover the front edge of the visor, the plate having a top planar member conforming to a substantial portion of the top surface of the visor and a bottom planar member conforming to a substantial portion of the bottom surface of the visor; and a fastening mechanism adapted to releasably attach the plate to the visor.

2. The visor guard and brace of claim 1, wherein the fastening mechanism comprises a void between the top and bottom planar members to receive and hold the baseball cap type visor.

3. The visor guard and brace of claim 2, wherein the void defines a surface which conforms to the front edge of the visor.

4. The visor guard and brace of claim 1, wherein the plate defines one continuous piece formed from a material selected from the group consisting of precious metal, non-precious metal, spring steel, metal alloy, rigid polymer, polyolefins, polyamides, polyethylene, polypropylene, and copolymers and terpolymers thereof.

5. The visor guard and brace of claim 1, wherein the top and bottom planar members are formed separately and joined together to form a "U" shape void to accept a visor bill.

6. The visor guard and brace of claim 1, wherein the top and bottom planar members form a "U" shape void to accept a visor bill.

7. The visor guard and brace of claim 1, further comprising a display device adapted to mount to the plate.

8. The visor guard and brace of claim 7, wherein the display device defines a two dimensional design.

9. The visor guard and brace of claim 7, wherein the display device defines a three dimensional design.

10. The visor guard and brace of claim 7, wherein the display device is a plate.

11. The visor guard and brace of claim 7, wherein the display device is formed of a metal.

12. The visor guard and brace of claim 7, wherein the display device is formed of a polymer.

13. The visor guard and brace of claim 7, wherein the display device defines a figurine.

14. The visor guard and brace of claim 1, further comprising a display device integrally formed with the plate.

15. The visor guard and brace of claim 1, wherein the plate further defines an ornamental design.

16. The visor guard and brace of claim 1, wherein the bottom planar member is positioned partially beneath the visor.

17. The visor guard and brace of claim 1, wherein the top planar member is positioned partially above the visor.

18. The visor guard and brace of claim 1, wherein the substantially rigid plate is formed of a fluorescent material.

19. A visor guard and brace, adapted to attach to and remain on a visor of a cap while worn by a wearer, the visor having a top surface, a bottom surface, a left edge, a right edge, and a front edge, the guard and brace comprising:

a substantially rigid plate of predetermined area adapted to conform to a surface of a cap visor and to cover the front edge of the visor, the plate having a top planar member conforming to a substantial portion of the top surface of the visor and having a front edge and a back edge;

a bottom planar member conforming to a substantial portion of the bottom surface of the visor and having a front edge and a back edge; and a single joining member connecting the front edge of the top planar member and the front edge of the bottom planar member, leaving the back edge of the top planar member and the back edge of the bottom planar member in a spaced apart relation.

20. The visor guard and brace of claim 19, wherein the top planar member, the bottom planar member, and the joining member comprise an article of manufacture formed of a single contiguous material and wherein the joining member comprises a fold.

* * * * *